US009630120B2

(12) United States Patent
Stubenfoll

(10) Patent No.: US 9,630,120 B2
(45) Date of Patent: Apr. 25, 2017

(54) TOY OR GAME WITH ILLUMINABLE TUBE

(71) Applicant: Leonard J. Stubenfoll, Orland Park, IL (US)

(72) Inventor: Leonard J. Stubenfoll, Orland Park, IL (US)

( * ) Notice: Subject to any disclaimer, the term of this patent is extended or adjusted under 35 U.S.C. 154(b) by 0 days.

(21) Appl. No.: 14/329,916

(22) Filed: Jul. 12, 2014

(65) Prior Publication Data

US 2016/0008730 A1 Jan. 14, 2016

(51) Int. Cl.

| | |
|---|---|
| ***A63H 29/08*** | (2006.01) |
| ***A63H 33/00*** | (2006.01) |
| ***A63H 33/26*** | (2006.01) |
| ***A63H 33/22*** | (2006.01) |
| ***A63H 37/00*** | (2006.01) |
| ***A63H 17/00*** | (2006.01) |

(52) U.S. Cl.

CPC ..... *A63H 33/009* (2013.01); *A63H 17/008* (2013.01); *A63H 33/22* (2013.01); *A63H 33/26* (2013.01); *A63H 37/00* (2013.01)

(58) Field of Classification Search

USPC ..... 446/168, 170, 171, 176, 199, 200, 202, 446/219

See application file for complete search history.

(56) References Cited

U.S. PATENT DOCUMENTS 3,141,340 A * 7/1964 Boehm ..... G01V 7/16 73/382 R
3,237,512 A * 3/1966 Beverett ..... A63F 7/044 353/2
3,253,354 A * 5/1966 Gollner ..... G09B 23/12 434/300
3,391,935 A * 7/1968 Gross ..... A63B 67/083 273/377
3,423,872 A * 1/1969 Dodson ..... A63H 33/00 273/109
3,950,890 A * 4/1976 Kittell ..... A63H 5/00 446/415
4,120,116 A * 10/1978 Williams ..... G02B 27/08 359/617
4,588,387 A * 5/1986 Swenson ..... A63H 5/00 362/205
4,678,450 A 7/1987 Scolari et al.
4,725,256 A * 2/1988 Sassak ..... A63F 7/3622 446/132
5,021,019 A * 6/1991 Gandy ..... A47G 21/182 239/33
5,037,346 A * 8/1991 Cimock ..... A63H 33/00 362/806
5,279,513 A * 1/1994 Connelly ..... A63H 33/009 446/219

(Continued)

*Primary Examiner* — Kurt Fernstrom
(74) *Attorney, Agent, or Firm* — John S. Pacocha

(57) ABSTRACT

A toy or game with an illuminable transparent or translucent tube has a moveable part in the tube and a power source adjacent an end of the tube for selectively controllable movement of the part. The part may be a moveable light source or a separate stationary light source may be adjacent one end of the tube with the moveable part blocking light from the light source. The power source and the light source may be adjacent the same end of the tube or may be adjacent opposed ends. The power source may be an elastic element or compressed gas. Air flow through the blower is adjusted by user manipulable controls.

24 Claims, 9 Drawing Sheets

(56) References Cited

U.S. PATENT DOCUMENTS

| | | | | |
|---|---|---|---|---|
| 5,522,756 | A * | 6/1996 | Barthold | A63H 33/00 446/193 |
| 6,036,576 | A * | 3/2000 | Colon, Jr. | A63H 33/009 446/170 |
| 6,485,349 | B1 * | 11/2002 | Snyder | A63H 29/08 446/168 |
| 6,551,183 | B2 * | 4/2003 | Knox, Jr. | G07F 11/14 446/168 |
| 7,306,231 | B2 * | 12/2007 | Callahan | G07F 17/3216 273/447 |
| 7,402,092 | B1 * | 7/2008 | Randall | A47G 19/2227 220/705 |
| 7,544,017 | B2 * | 6/2009 | Keagy | G09F 19/00 406/13 |
| 7,766,721 | B2 * | 8/2010 | Ma | A63H 33/009 446/473 |

* cited by examiner 20
22
24
28
30
34
36
40
44
46
48
50
54
56
58
60
64
66
68
70
72
74
80
82
86
88
90
92

TOY OR GAME WITH ILLUMINABLE TUBE

BACKGROUND OF THE INVENTION

1. Field of the Invention

This invention relates generally to toys or games, particularly toys or games which a child may manipulate to change how much of the toy or game is illuminated.

2. Background Art

There are many prior art toys and games that are, at least in part, illuminated and since the initial 1977 "STAR WARS" movie there have been a number of light swords. Colon U.S. Pat. No. 6,036,576 issued Mar. 14, 2000 discloses a Light Sword Toy With Moving Internal Object comprising a translucent material tube having a light source located at the proximal end directing light into the tube toward the distal end. A ball within the tube is initially at the proximal end blocking nearly all of the light from reaching the distal end. However, when the toy sword is tilted from an upright position, the force of gravity causes the ball to roll toward the distal end and the illumination appears to travel toward the distal end. There is a ball retaining mechanism at the distal end for holding the ball until it may be released by the user to return it to the proximal end of the tube.

There remains a need, however, for toys or games in which a child may manipulate how much of the toy or game is illuminated through other than the force of gravity.

SUMMARY OF THE INVENTION

The present invention is concerned with providing a toy or game with an illuminable tube comprising a length of transparent or translucent tube having opposed ends, a light source for lighting the tube, a moveable part in the tube, a power source adjacent one end of the tube, and power from the power source moving the part from proximate the one end of the tube toward the other of the opposed ends of the tube.

The moveable part may include the light source. The part may be between the light source and the other of the opposed ends of the tube and blocks light from the light source. The light source may be adjacent the same one end of the tube as the power source. The light source may be adjacent the other of the opposed ends of the tube than the one to which the power source is adjacent. There may be a light source and a power source adjacent each of the opposed ends of the tube.

The power source may be a fluid such as compressed air. The power source may be an elastic such as a coil spring.

A base or handle may be adjacent the same one end of the tube as the power source, and the base or handle may contain the power source. The other of the opposed ends of the tube than the one to which the power source is adjacent may be substantially closed with respect to passage of the moveable part. The other of the opposed ends of the tube than the one to which the power source is adjacent may be open with respect to passage of the moveable part.

A sensor responsive to the moveable part may be adjacent the other of the opposed ends of the tube than the one to which the power source is adjacent. The sensor may shut off the light source when the moveable part engages the sensor.

The toy or game with an illuminable tube may comprise a length of transparent or translucent tube having opposed ends, a blower adjacent one end of the tube, a light source for lighting the tube, a moveable part in the tube, and air flow from the blower moving the part from proximate the one end of the tube toward the other of the opposed ends of the tube.

The air flow may be adjusted to control the movement of the part in the tube. A base or handle may be adjacent the same one end of the tube as the blower, the base or handle having a tube end and an opposed end, the base or handle containing the blower, the blower having an intake side and an exhaust side, the exhaust side being adjacent the tube, and the opposed end of the base or handle having an opening for air flow into the intake side of the blower. Manual obstruction of the opening may adjust the air flow to control the movement of the part in the tube. The base or handle may contain a valve for adjusting the air flow to control the movement of the part in the tube, and the base or handle may carry an actuator for the valve.

BRIEF DESCRIPTION OF THE DRAWINGS

For a better understanding of the present invention, reference may be had to the accompanying drawings in which.

DETAILED DESCRIPTION

Figures 1, 2, 3:
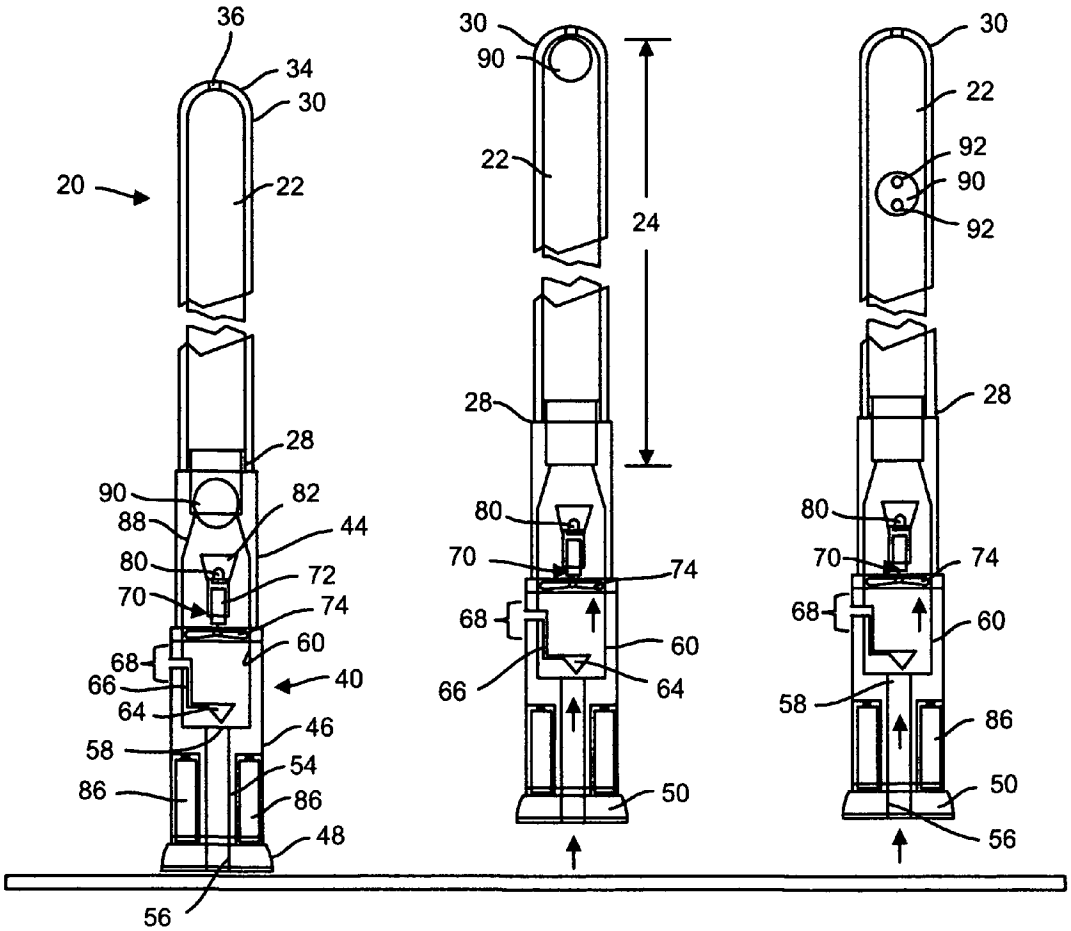
FIG. 1 is a sectional view of an embodiment of the present invention.
FIG. 2 is a similar sectional view of the embodiment shown in FIG. 1 but in another stage of operation.
FIG. 3 is another similar sectional view of the embodiment shown in FIG. 1 but in yet another stage of operation.

Referring now to the drawings, in which like elements are identified by like reference numerals, there is shown in FIGS. 1-3 an embodiment of the present invention comprising a toy 20 with an illuminable tube 22. More particularly, illuminable tube 22 is of a transparent or translucent plastic material and has a length 24 extending between a handle or base open proximal end 28 and a distal end 30. As shown in FIGS. 1-3, distal end 30 of tube 22 is substantially closed, except as to air flow, by a domed end cap 34 having an air hole 36.

Tube 22 is mounted adjacent its open end 28 to a base or handle 40. As shown in FIGS. 1-4, base or handle 40 is a generally cylindrical hollow casing 42 with an upper portion 44, a middle portion 46 and a lower portion 48 flaring out to a larger diameter generally flat bottom 50. Extending upwardly an air intake opening 54 extends upwardly from otherwise substantially closed bottom 50. Opening 54 has an inlet 56 adjacent bottom 50 and an outlet 58 in communication with a chamber 60 in base or handle 40.

Within chamber 60 is a valve 64 controlled by manual movement of a slide actuator 66 carried by base or handle 40. A valve actuator button 68, on the outside of base or handle 40 provides for manual adjustment of the valve by a user. Valve 64 is positioned over outlet 58 of air intake opening 54. Manual sliding movement of external button 68 controls movement of valve 64 between an air flow open position as shown in FIGS. 1 and 2 to a position as shown in FIG. 3 closing off air flow into chamber 60.

Spaced above air intake opening 54 and valve 64 is a blower 70 with a electric drive motor 72 and fan 74. Above blower 70 is an LED light source 80 which may be provided with a reflector 82. Between bottom 50 and chamber 60 a number of batteries 86 are housed around air intake opening 54. In the embodiment shown in FIGS. 1-3, up to four AA or AAA batteries 54 may be housed. Batteries 84 provide power to drive blower motor 72 and light LED 80 through conventional circuitry (not shown) including an on/off switch (not shown).

As illustrated in FIGS. 1-3, light source 80 is mounted in upper portion 44 of base or handle 40. Upper portion 40 has an inside truncated conical portion 88 above blower 70 and light source 80 that communicates with open proximal end 28 of tube 22. Inside of tube 22 is a part 90 of light blocking or reflective material. In the present embodiment part 90 is a lightweight ball, although it could be another shape such as a cylinder, of a diameter a little less than the inside diameter of the tube and a little more than the inside diameter of the top of truncated conical portion 88. Thus, part 90 is moveable by air flow from blower 70 away from proximal end 28 toward and up to distal end 30. When adjacent proximal end 28 as shown in FIG. 1, part 90 blocks light from LED source 80 from being transmitted through tube 22. With valve 64 open, as illustrated in FIG. 2, ball or slider part 90 may be moved by the air flow of blower 70 all the way to distal end 30. With light blocking part 90 at the distal end 30, and LED source 80 energized, the entire length of tube 22 is illuminated.

By user sliding manual movement of button 68 the air flow is controlled through valve 64 to selectively position part 90 virtually anywhere along the length of tube 22 such as to the position illustrated in FIG. 3. With valve 64 shut, air flow through blower 70 will cease and part 90 will drop to proximal end 28, essentially the same position as illustrated in FIG. 1. Control of air flow from blower 70 could also be accomplished by shutting off the power to blower motor 72.

Moveable part 90 as illustrated in FIGS. 1 and 2 is a solid lightweight ball akin to a Ping Pong ball. However, in FIG. 3 a modification is illustrated in which part 90 is provided with holes 92. Generally as part 90 moves up and down in tube 22 it tends to rotate. With one or more holes 92, the rise and fall of part 90 is sometimes randomly affected as the part rotates and one or more of the holes is in the stream of air. In addition, multiple holes 92 may result in a rotating or spinning "disco" light effect as light enters and exits the holes rather than merely reflecting off the solid surfaces of part 90.

Figure 4:
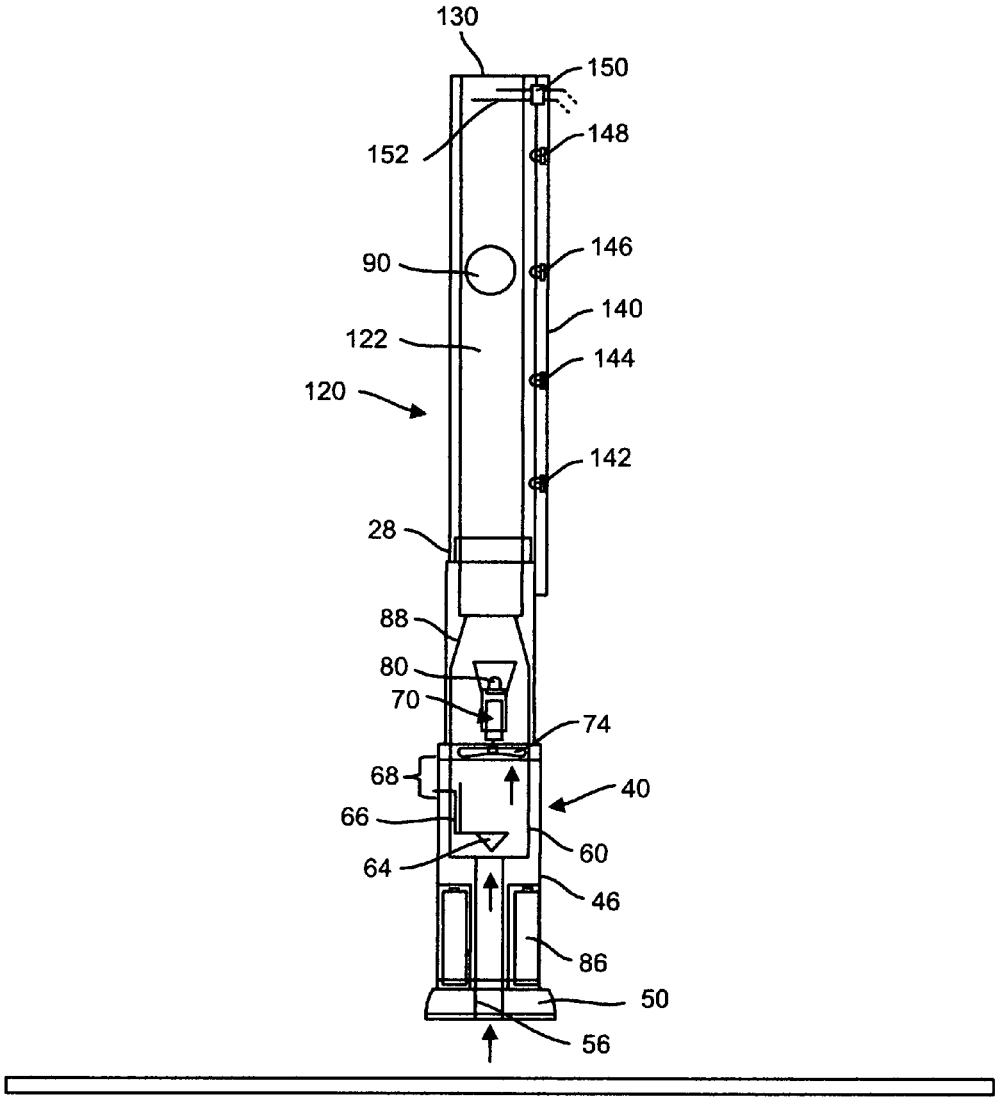
FIG. 4 is a sectional view of another embodiment of the present invention in a stage of operation similar to that illustrated in FIG. 3.

FIG. 4 illustrates another embodiment of the present invention in which toy or game 120 has many of the same components or elements previously shown and described with respect to toy 20 and which are identified by the same reference numerals. However, in the embodiment of FIG. 4 the tube 122 does not have a domed end cap 34 and distal end 130 is completely open. Another difference is the addition of a strip or column 140 positioned along the outside of tube generally parallel to the axis of the tube. As illustrated in FIG. 4, generally vertical strip or column 140 carries LED light sources 142, 144, 146 and 148 directed inwardly toward tube 122. Each LED may be of a different color and transmits that color to part 90 when it is aligned with a particular LED. A similar strip or column could be added to the embodiment illustrated in FIGS. 1-3.

Players use sliding manual movement of button 68 as described with respect to the embodiment shown in FIGS. 1-3 to control the air flow in the direction illustrated by the arrows to selectively move part 90 along the length of tube 122 and align it with a particular one of LEDs 142, 144, 146 or 148.

The open distal end 130 of this embodiment adds another play feature in that a level of skill is required to keep part 90 from being blow out the open distal end 130. Alternatively, this feature may be used to intentionally propel part 90 out of open distal end 130 for race or target type play.

A sensor 150, illustrated in FIG. 4 as an electrical switch 152, is positioned adjacent distal open end 130. When part 90 passes by and engages switch 152 on being blown out toward open distal end 130 light source 80 is shut off through conventional circuitry (not shown). Sensor 150 may also be used with a closed end tube 22.

Figure 5:
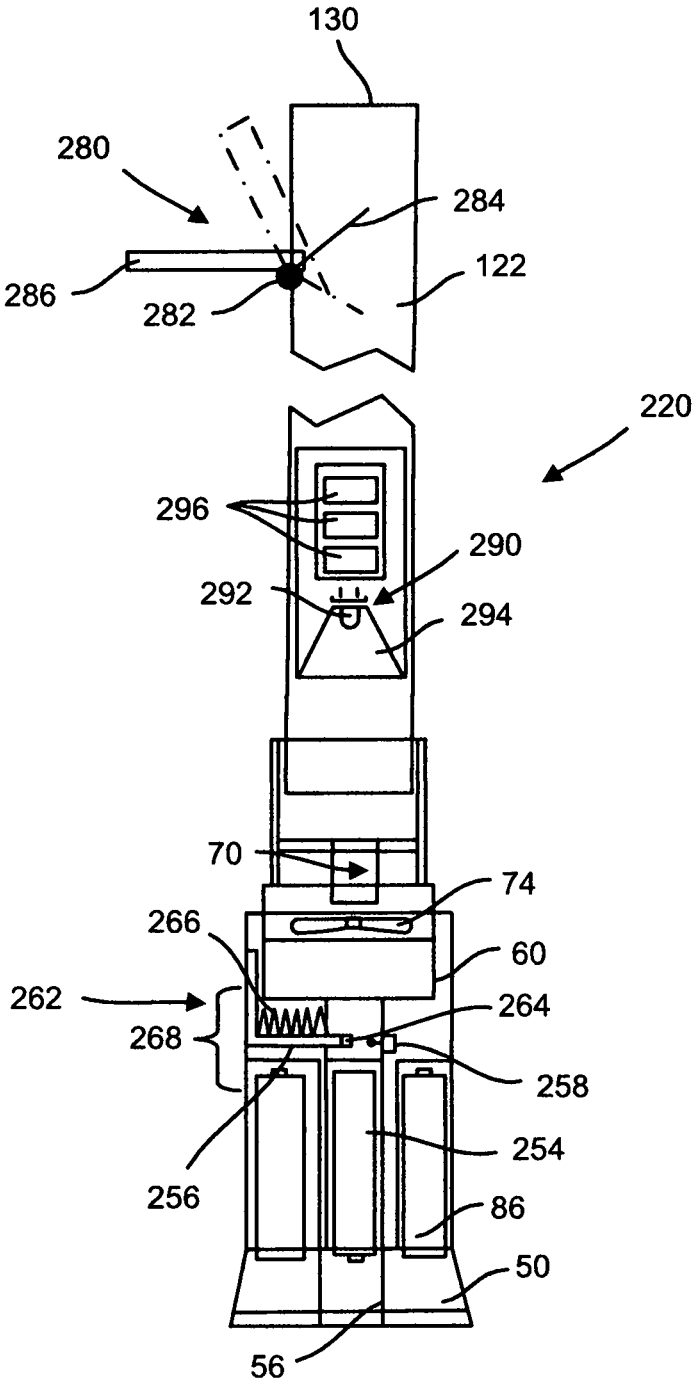
FIG. 5 is an enlarged sectional view of yet another embodiment of the present invention in a stage of operation similar to that illustrated in FIGS. 3 and 4.

The toy or game 220 illustrated in FIG. 5 may have a distal end 130 that is open as in the embodiment illustrated in FIG. 4 or it may have a domed end cap 34 as in the embodiment illustrated in FIGS. 1-3. As in the previous embodiment the same components or elements previously shown and described with respect to toys 20 and 120 are identified by the same reference numerals. Toy or game 220 differs from the embodiments previously shown and described in the air flow control mechanism 262. An air intake opening 254, similar to air intake opening 54, has a transverse slot 256 in one side wall and a notch 258 in the opposite wall. Air flow control mechanism 262 includes a plate 264 that slides across air intake opening 254 through slot 256 into notch 258 to selectively block some or all of the air flow. A coil spring 266 biases plate 264 towards a fully open position. The user may manually depress a button 268 against the bias of spring 266 to selectively block slide plate 264 into and across air intake 254 to block some or all of the air flow from reaching chamber 60.

In addition, toy or game 220 of FIG. 5 also illustrates a different moveable part 290 which incorporates the light source in contrast to the separate stationary LED light source 80 of the previous embodiments. Part 290, which may be in the shape of a cylinder, has a diameter a little less than the inside diameter of tube 22 and a little more than the inside diameter of the top of truncated conical portion 88. A self contained LED light 292, reflector 294 and battery power source 296 are carried by part 290. Batteries 296 may, for example, be LR 44 button cells or some other suitable lightweight batteries. Part 290 is itself made of a lightweight light blocking or reflective material and is moveable by air flow from blower 70 away from proximal end 28 toward and up to distal end 30. LED 292 and reflector 294 are directed downwardly toward base 40 and blower 70. Accordingly, as air flow from blower 70 moves part 290 away from proximal end 28 toward distal end 130, the in-between portion of tube 122 will be illuminated. As a further variation part 290 may be styled as a vehicle to be launched by blower 70 out of open distal end 130.

Another type of sensor 280 is illustrated in FIG. 5 as a mechanical pivoting flap 252, is positioned adjacent distal open end 130. Sensor 280 includes a pivot or fulcrum 282 which can be outside, part of, or inside tube 122. On either side of pivot 282 are a trip lever 284, which is substantially within tube 122 and engageable by the moveable part, and a flap 286, which is substantially outside of tube 122. Initially, lever 284 and flap 286 are in the position shown in broken line with lever 284 tipped down in tube 122 and flap 286 tipped up along the outside of tube 122. When part 290 is blown up and engages lever 284 it is moved up to the position shown in solid line and flap 286 pivots down to the position shown in solid line. Flap 286 could be styled as could be as a tongue pivoting out of a mouth, a finger pivoting down onto a card, a hammer slamming down onto a game piece, or anything compatible with the overall theme of the toy or game.

Sensor 280 could itself be used to shut off a light source through conventional circuitry (not shown), or it could be combined with a sensor 150, as illustrated in FIG. 4. Like sensor 150, sensor 280 may also be used with a closed end tube 22.

Figure 6:
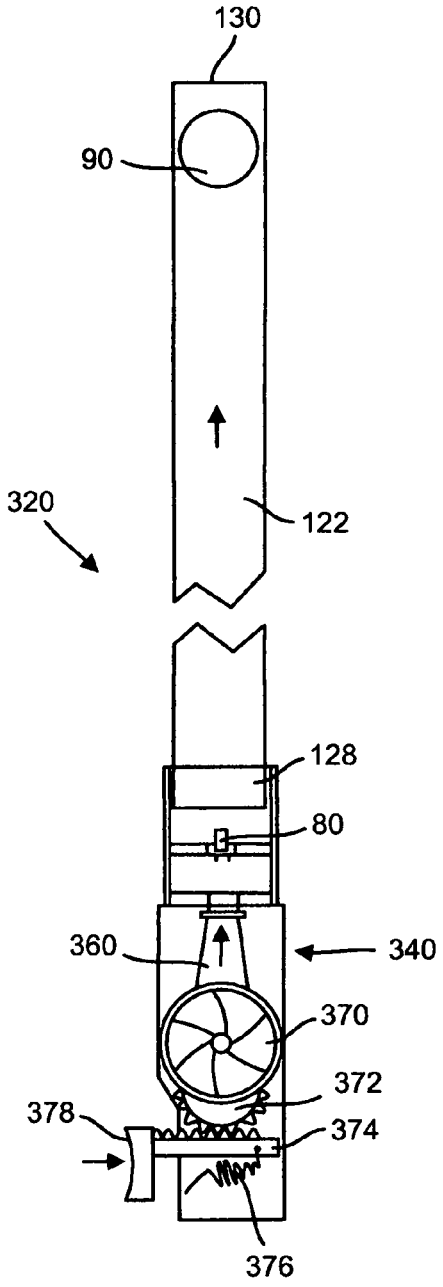
FIG. 6 is a sectional view of still another embodiment of the present invention in a stage of operation similar to that illustrated in FIG. 2.

While the embodiments of FIGS. 1-5 have used a generally axially oriented electric blower, the blower does not have to be electrically powered and could be radial or some other power source such as a bellows or spring could be used in the present invention. FIG. 6 illustrates a toy or game 320 in which the same components or elements previously shown and described with respect to toy 20 and 120 are identified by the same reference numerals. However, in the embodiment of FIG. 6 the axial blower, motor and fan (70, 72 and 74) are replaced with a radial impeller blower 370 powered through a gear 372 driven by a rack 374 moveable generally transverse to the axis of tube against the bias of a spring 376 by a user manually pushing on trigger 378.

Radial impeller blower 370, gear 372, rack 374 and spring 376 are mounted in base or hollow handle 340 with trigger 378 (and a portion of rack 374) carried on the outside. Manually pushing trigger 378 in the direction of the illustrated arrow moves rack 374 against the bias of spring 376 to rotate gear 372 and blower 370. Rotation of the generally radial impellers of blower 370 delivers air flow through duct 360 to proximal end 128 of tube 122 to move part 90 up as indicated by the arrows illustrated in duct 360 and tube 122.

Figure 7:
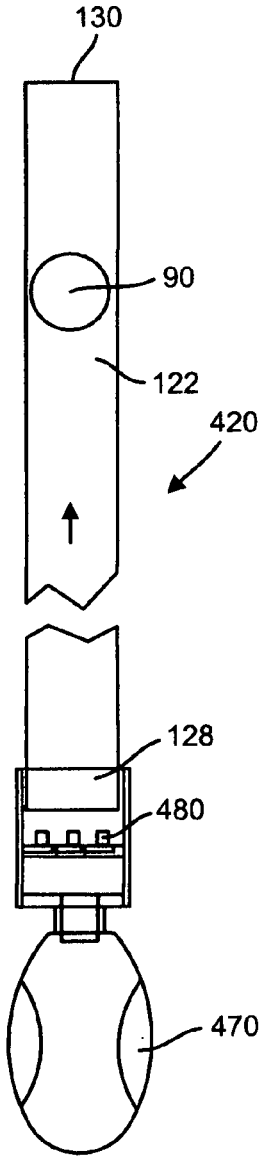
FIG. 7 is a sectional view of a further embodiment of the present invention in a stage of operation similar to that illustrated in FIGS. 3 and 4.

FIG. 7 illustrates a toy or game 420 in which the same components or elements previously shown and described with respect to toy 20 and 120 are again identified by the same reference numerals. However, in the embodiment of FIG. 7 the axial blower, motor and fan (70, 72 and 74) are replaced with a manually compressible hollow bulb 470 of rubber or other elastic material to move part 90 up as indicated by the arrow in tube 122. In addition, the embodiment of FIG. 7 illustrates the use of an array 480 of a multiple number of LEDs.

Figure 8:
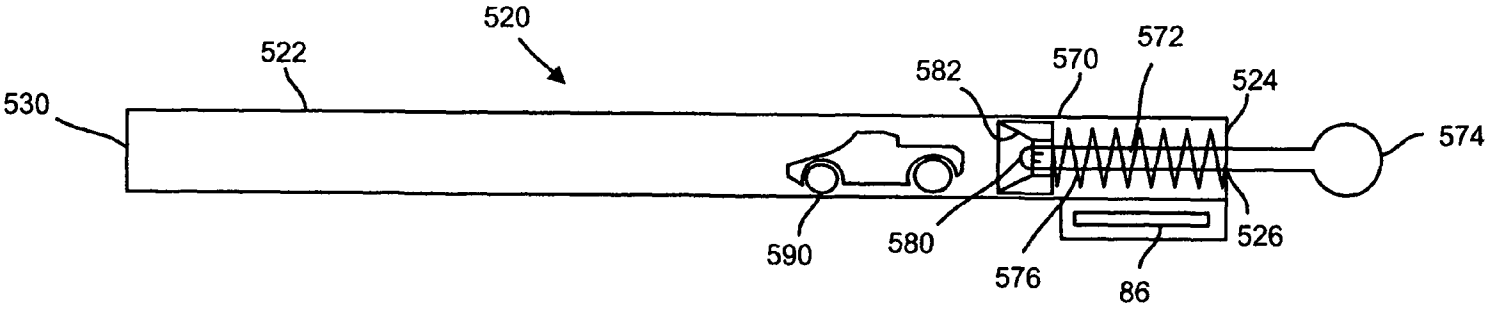
FIG. 8 is a sectional view of another further embodiment of the present invention.
Figure 9:
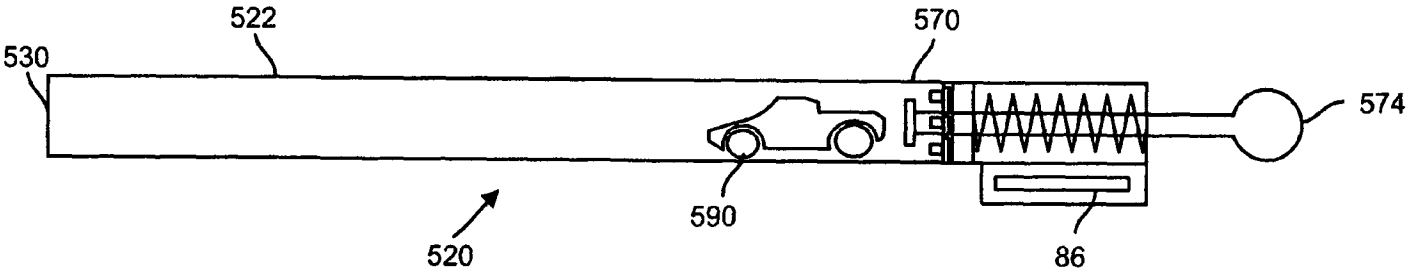
FIG. 9 is another sectional view of a variation of the embodiment of the present invention illustrated in FIG. 8.

FIGS. 8 and 9 illustrate a toy or game 520 having a tube 522 with a substantially closed proximal end 524 having a generally axially aligned aperture 526 and an open distal end 530. The axial blower, motor and fan (70, 72 and 74) of the embodiments in FIGS. 1-5 are replaced with an elastic power source including a manually retractable plunger 570 on one end of a shaft 572 extending out of proximal end 524 of tube 522 through aperture 526 and having a handle or knob 574 on the other end outside of tube 522. A compressible coil spring 576 is mounted around shaft 572 and contained, together with plunger 570, within tube 522. Instead of a coil spring 576 some other elastic element such as a rubber band (which would be put in tension rater than in compression as the spring) could be used to power the moveable part.

In the embodiment illustrated in FIG. 8 an LED light source 580 and reflector 582 are integral with and move together with plunger 570. As a variation, the embodiment illustrated in FIG. 9 has a stationary array 588 of LEDs. One or more batteries 86 provide power for the light source.

Although a moveable part 90 could be used, FIGS. 8 and 9 also illustrate the use of a moveable part 590 that may be made of soft plastic foam in a shape styled as a vehicle or the like. Such a styled moveable part or slider may not exactly conform in shape to the interior of tube 522. However, it does sufficiently fill the interior cross-section of the tube to obstruct, and hence be moved by, a power source such as the plunger 570 or an air flow produced by any of the blowers of the present invention.

Figure 10:
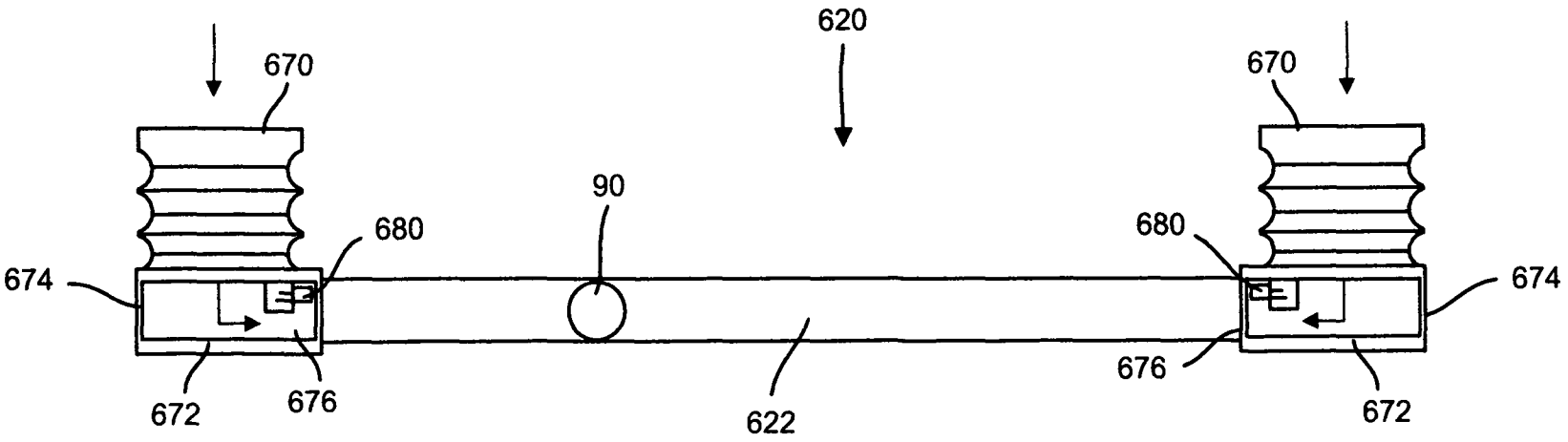
FIG. 10 is a sectional view of yet another further embodiment of the present invention.

FIG. 10 illustrates a toy or game 620 in which a tube 622 containing a moveable part 90 has a power and light source at each end. The axial blower, motor and fan (70, 72 and 74) of the embodiments illustrated in FIGS. 1-5 are replaced with a manually compressible hollow bellows 670 of rubber or other elastic material at each end of the tube. Each bellows 670 is mounted on and is in fluid communication with a generally rigid chamber 672 that has a closed distal end 674 and an open proximal end 676 in fluid communication with a respective end of tube 622. An LED light source 680 powered by batteries (not shown) is mounted in each chamber 672 adjacent tube 622.

Each player may manually compress an assigned bellows to move part 90 toward the opponent's end with the illumination of the tube providing a ready and entertaining indication of the progress of the game. The light source adjacent each end may be of a different color to enhance the contrast of the indication of the progress of the moveable part 90 toward an opposing end. As illustrated in FIG. 10, tube 622 is generally horizontally disposed, although it could be vertical or at some angle in between. Orienting tube 622 toward the vertical would result in the player at the higher end having an advantage due to gravity.

Figure 11:
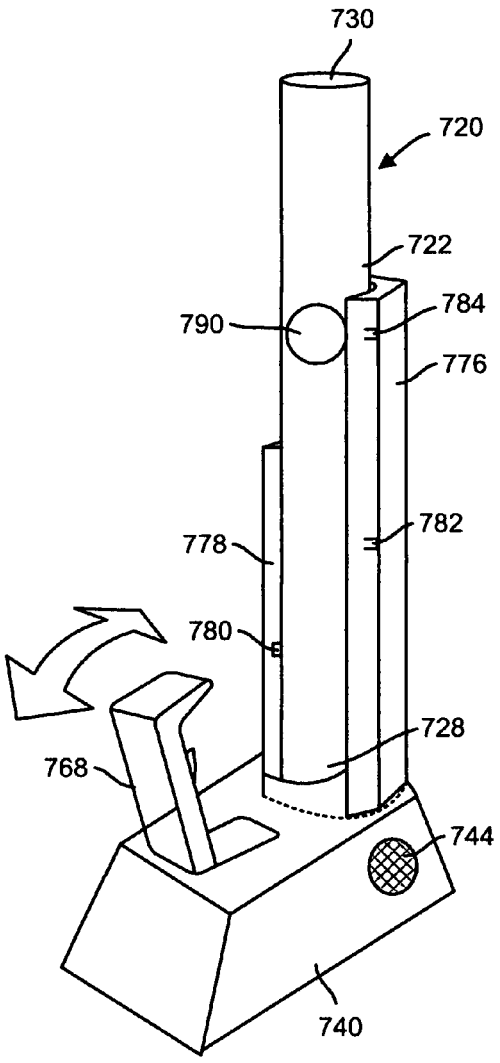
FIG. 11 is a perspective view of still another further embodiment of the present invention.

A game 720 is illustrated in FIG. 11 which has a tube 722 with its proximal end 728 mounted in a base 740 suitable for resting on a floor, tabletop or other substantially flat surface. The distal top end 730 of the tube is illustrated as open although it may be provided with a domed end cap 34. Inside of base 740, positioned under proximal end 728, is a blower (not shown) which may be similar to blower 70. Also contained in base 740 are a chamber, air intake and air flow control mechanism (not shown) which may be similar to either of the ones shown and described with respect to the embodiments of FIGS. 1-5. However, instead of either actuator button 68 or 268, game 740 is provided with an actuator control lever 768. Pulling back on lever 768, away from tube 722, will block air flow into the blower while pushing forward, toward tube 722, will increase air flow causing a lightweight moveable part 790 of a translucent material to rise in tube 722.

A light source, similar to light source 80, inside of base 740 may, or may not, be positioned inside base 740 adjacent proximal end 728 of tube 722 as for example in the embodiments of any of FIGS. 1-4. Although a light source in the base is preferred, it is not essential to this embodiment. Base 740 may also be provided with an opening or a speaker grill 744 for a sound system (not shown) housed in base 740.

Positioned along the outside of tube 722 are vertical columns 776 and 778 carrying LED light sources 780, 782 and 784 directed inwardly toward the tube. Each LED is of a different color and transmits that color to part 790 when it is aligned with a particular LED. While illustrated as having at least one LED in an opposing vertical column, all of the LED lights could be in the same column or strip as in the embodiment illustrated in FIG. 4. Although a light source in the base is not essential to this embodiment, it does combine with the LED colored lights to enhance the overall effect of the illumination feature of this game.

Players use control lever 768 to move illustrated ball 790, which could be a slider of a different shape, up and down in tube 722 to the right spot in the tube to light it up with a designated color. A timed randomizer providing audio instructions conventionally used in prior art games may be housed in base 740 to designate the colors. Allowing ball or slider 790 to be blown out of the open top end, or hit the domed end cap, may end a player's turn or result in the loss of points.

Figure 12:
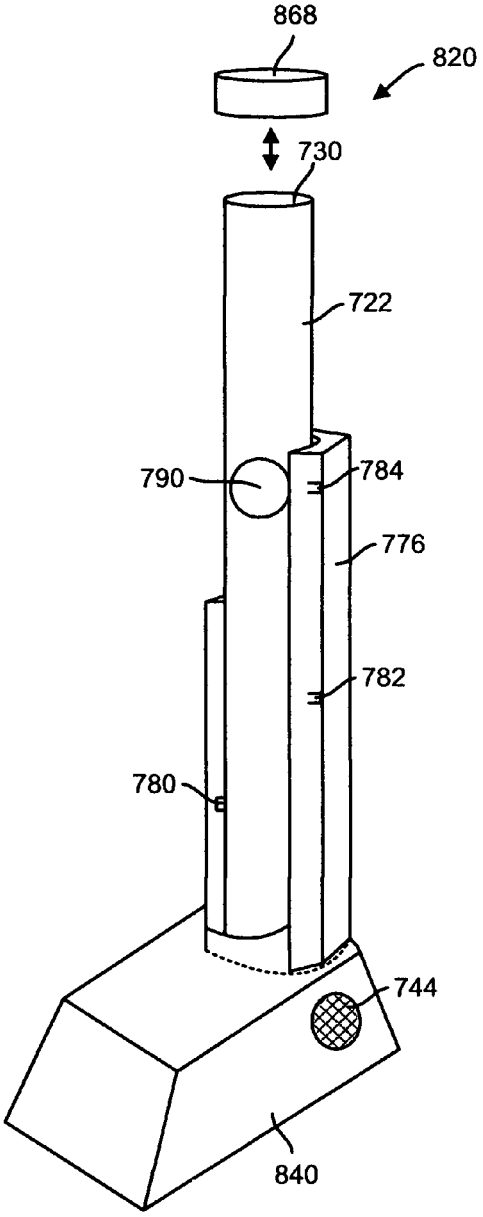
FIG. 12 is a perspective view of an additional embodiment of the present invention.

FIG. 12 illustrates a game 820 similar to game 720 but with a different air flow control mechanism. Again, as in the previous embodiments, the same components or elements previously shown and described are again identified by the same reference numerals. In this embodiment the proximal end 728 of tube 722 is mounted in a base 840 which is suitable for resting on a floor, tabletop or other substantially flat surface. The distal top end 730 of the tube is illustrated as open although it may be provided with a domed end cap 34.

Inside of base 840, positioned under proximal end 728, is a blower (not shown) which may be similar to blower 70. Also contained in base 840 are a chamber and an air intake (not shown) which may be similar to chamber 60 and air intake opening 54 similar to the ones shown and described with respect to the embodiments of FIGS. 1-5. However, instead of either actuator button 68 or 268 or control lever 768, game 820 is provided with an actuator control cap 868 for use with an open distal end 730. Pulling cap 868 away from open distal end 730 will allow air flow through the blower and tube 722 causing part 790 to rise in tube 722. Conversely, pushing cap 868 toward tube 722 blocking open distal end 730 will decrease air flow causing part 790 to drop in tube 722. With a domed end cap 34 players may use a thumb or finger to block or unblock air hole 36 to similarly control the rise and fall of ball 790.

Game 820 has the same colored LED lights and timed randomizer providing audio instructions as in game 720. A light source and sound system (not shown) may be included in base 840 as in base 740. Base 840 may also be provided with an opening or a speaker grill 744 for a sound system.

Figure 13:
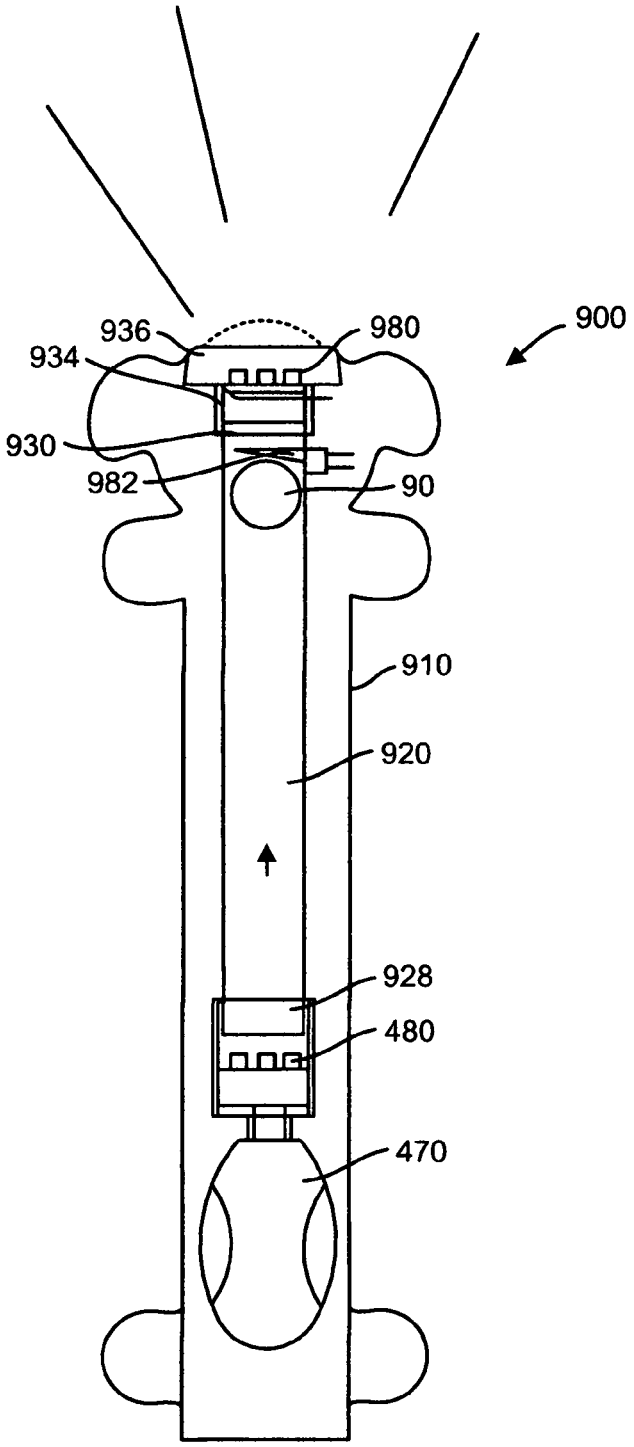
FIG. 13 is a sectional view of a further additional embodiment of the present invention.

An infant toy embodiment 900 is illustrated in FIG. 13 with a generic plush outer covering 910 which includes a head with ears, arms, and legs. Contained in plush covering 910 is an illuminable tube 920, which may be any one of the embodiments of FIGS. 1-10. FIG. 13 illustrates a variation of the embodiment of FIG. 7 in which tube 922 of a transparent or translucent plastic material, has a proximal end 928 and an open distal end 930. Mounted atop end 930 is a cap 934 carrying a light diffusing lens 936. The body and head of the plush covering may be provided with openings or transparent portions (not shown) through which light would be transmitted as part 90 moves within tube 922.

In addition to an array 480 of a multiple number of LEDs below proximal end 928 and above manually compressible hollow bulb 470, an array 980 of a multiple number of LEDs may be mounted. Part 90 could activate the array 980 by being moved up tube 922 to trip a switch 982 similar to switch 152 of the toy or game of FIG. 4.

Figure 14:
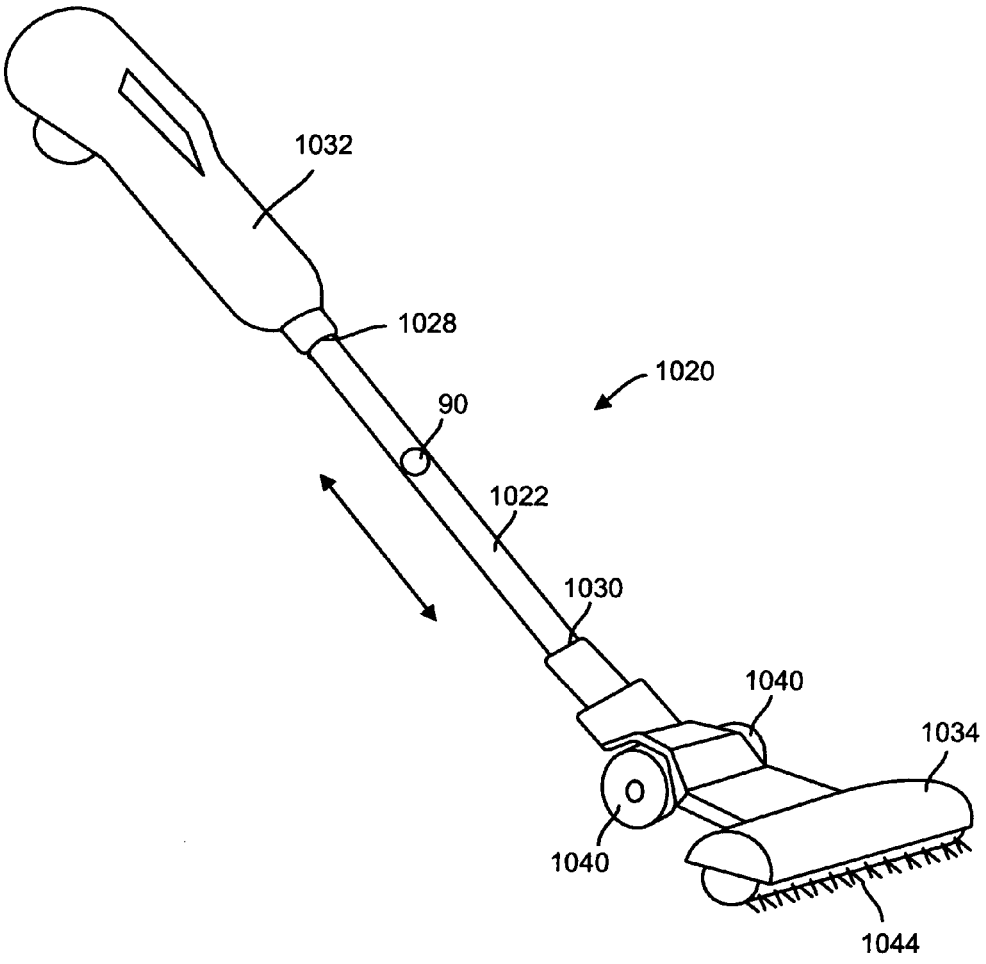
FIG. 14 is a perspective view of another further additional embodiment of the present invention.

FIG. 14 shows a push toy embodiment which is illustrated as a vacuum cleaner 1020 although it could styled as something else, such as a lawn mower. An illuminable tube 1022, like the previously described tubes of the present invention, is of a transparent or translucent plastic material. Tube 1022 has a proximal end 1028 and a distal end 1030 between which part 90 is moveable as indicated by the arrows alongside tube 1022. Proximal end 1028 is connected to a stylized handle 1032. Distal end 1030 is connected to a vacuum cleaner head 1034 having wheels 1040 and a brush 1044 that rotate as the vacuum cleaner is pushed along a floor or other substantially flat surface.

A battery powered blower (not shown) may be housed in vacuum cleaner head 1034 with actuator button 68 or 268 operated through a cam (not shown) driven by the rotation of either wheels 1040 or brush 1044. Alternatively, a radial impeller blower 370 in vacuum cleaner head 1034 adjacent distal end 1030 operated through gears (not shown) driven by the rotation of either wheels 1040 or brush 1044 could be used. In another variation, stylized handle 1032 could be provided with the axial blower, motor and fan (70, 72 and 74) and an operating control button (68 or 268) as in the embodiments of FIGS. 1-5.

While particular embodiments of the invention have been shown and described with some variations and alternatives, further variations and modifications will occur to those skilled in the art. For example while the tubes of the present invention have been described and illustrated as cylindrical with a generally circular cross-section and the moveable parts as generally spherical or cylindrical, the invention is not limited to those particular shapes, as indicated in some of the embodiments. Indeed, the cross-section of the tubes could be oval, octagonal, hexagonal, square or virtually any polygon, and while the moveable part should generally conform to shape of the tube interior, it does not have to be exact. It is intended in the appended claims to cover all such variations and modifications that come within the true spirit and scope of the present invention.

What is claimed as new and desired to be secured by Letters Patent is:

1. A toy or game with an illuminable tube comprising:
- a length of transparent or translucent tube having opposed ends;
- a light source for lighting the tube;
- a moveable part in the tube;
- a power source adjacent one end of the tube;
- power from the power source moving the part from proximate the one end of the tube toward the other of the opposed ends of the tube;
- control of the power source returning the part from proximate the other of the opposed ends of the tube toward the one end of the tube; and
- the moveable part is between the light source and the other of the opposed ends of the tube and blocks light from the light source causing a visual effect of light moving between the opposed ends of the tube.

2. The toy or game of claim 1 in which there are both a light source and a power source adjacent each of the opposed ends of the tube.

3. A toy or game with an illuminable tube comprising:
- a length of transparent or translucent tube having opposed ends;
- a light source for lighting the tube;
- a moveable part in the tube;
- a power source adjacent one end of the tube;

power from the power source moving the part from proximate the one end of the tube toward the other of the opposed ends of the tube; and the light source is adjacent the same one end of the tube as the power source.

4. A toy or game with an illuminable tube comprising:

a length of transparent or translucent tube having opposed ends;

a light source and a power source are adjacent each of the opposed ends of the tube for lighting the tube;

a power source adjacent each of the opposed ends of the tube;

a moveable part in the tube between both light sources and both power sources; and power from the power sources moving the part from proximate one end of the tube toward the other of the opposed ends of the tube.

5. A toy or game with an illuminable tube comprising:

a length of transparent or translucent tube having opposed ends;

a blower adjacent one end of the tube;

a light source for lighting the tube;

a moveable part in the tube;

air flow from the blower moving the part from proximate the one end of the tube toward the other of the opposed ends of the tube;

a base or handle adjacent the same one end of the tube as the blower;

the base or handle having a tube end and an opposed end;

the base or handle containing the blower;

the blower having an intake side and an exhaust side;

the exhaust side being adjacent the tube;

the opposed end of the base or handle having an opening for air flow into the intake side of the blower; and manual obstruction of the opening adjusting the air flow to control the movement of the part in the tube.

6. The toy or game of claim 5 in which the manual obstruction of the opening adjusting the air flow to control the movement of the part in the tube is provided by:

the base or handle containing a valve for adjusting the air flow to control the movement of the part in the tube; and the base or handle carrying an actuator for the valve.

7. The toy or game of claim 5 in which the blower is between the light source and the moveable part.

8. A toy or game with an illuminable tube comprising:

a length of transparent or translucent tube having opposed ends;

a blower adjacent one end of the tube;

a light source for lighting the tube;

a moveable part in the tube;

air flow from the blower moving the part from proximate the one end of the tube toward the other of the opposed ends of the tube; and the light source is between the blower and the moveable part.

9. The toy or game of claim 8 in which air flow into the blower is adjusted to control the movement of the part in the tube.

10. The toy or game of claim 9 in which:

the one end of the tube to which the blower is adjacent has a selectively closeable opening; and air flow into the blower is adjusted to control the movement of the part in the tube.

11. The toy or game of claim 8 in which:

the other of the opposed ends of the tube has a closeable opening; and air flow is adjusted by selectively closing and opening the closeable opening to control the movement of the part in the tube.

12. The toy or game of claim 8 in which the blower is powered by a user actuated trigger spring biased out of engagement with the blower.

13. The toy or game of claim 8 in which the blower is a radial impeller blower powered by a user actuated trigger spring biased out of engagement with the blower.

14. The toy or game of claim 8 in which:

the tube is contained within a soft covering; and the blower is also contained within the soft covering and comprises a manually compressible hollow bulb or bellows.

15. The toy or game of claim 8 in which there are both a blower and a light source adjacent each of the opposed ends of the tube.

16. The toy or game of claim 8 further comprising:

a base or handle adjacent the same one end of the tube as the blower;

an electric motor for driving the blower; and one or more batteries in the base or handle to power the electric motor and the light source.

17. The toy or game with an illuminable tube comprising:

a length of transparent or translucent tube having opposed ends;

a blower adjacent one end of the tube;

a light source for lighting the tube;

a moveable part in the tube;

air flow from the blower moving the part from proximate the one end of the tube toward the other of the opposed ends of the tube; and the light source is adjacent the other of the opposed ends of the tube.

18. The toy or game of claim 17 in which:

the one end of the tube to which the blower is adjacent has a selectively closeable opening; and air flow into the blower is adjusted to control the movement of the part in the tube.

19. The toy or game of claim 17 in which:

the other of the opposed ends of the tube has a closeable opening; and air flow is adjusted by selectively closing and opening the closeable opening to control the movement of the part in the tube.

20. The toy or game of claim 17 in which the blower is powered by a user actuated trigger spring biased out of engagement with the blower.

21. The toy or game of claim 17 in which the blower is a radial impeller blower powered by a user actuated trigger spring biased out of engagement with the blower.

22. The toy or game of claim 17 in which:

the tube is contained within a soft covering; and the blower is also contained within the soft covering and comprises a manually compressible hollow bulb or bellows.

23. The toy or game of claim 17 in which there are both a blower and a light source adjacent each of the opposed ends of the tube.

24. The toy or game of claim 17 further comprising:

a base or handle adjacent the same one end of the tube as the blower;

an electric motor for driving the blower; and one or more batteries in the base or handle to power the electric motor and the light source.

* * * * *